US009475622B2

(12) United States Patent
Skillin et al.

(10) Patent No.: US 9,475,622 B2
(45) Date of Patent: Oct. 25, 2016

(54) TAMPER EVIDENT POUCH AND DISPENSING FITMENT

(71) Applicant: MWV Slatersville, LLC, Richmond, VA (US)

(72) Inventors: Clifford W. Skillin, Blackstone, MA (US); Patrick J. Brannon, Warwick, RI (US); David A. Royer, Pascoag, RI (US)

(73) Assignee: WestRock Slatersville, LLC, Norcross, GA (US)

( * ) Notice: Subject to any disclaimer, the term of this patent is extended or adjusted under 35 U.S.C. 154(b) by 94 days.

(21) Appl. No.: 14/460,571

(22) Filed: Aug. 15, 2014

(65) Prior Publication Data

US 2015/0048112 A1 Feb. 19, 2015

Related U.S. Application Data

(60) Provisional application No. 61/867,044, filed on Aug. 17, 2013.

(51) Int. Cl.

| | |
|---|---|
| ***B65D 47/06*** | (2006.01) |
| ***B65D 47/08*** | (2006.01) |
| ***B65D 75/58*** | (2006.01) |

(52) U.S. Cl.

CPC ..... *B65D 47/0842* (2013.01); *B65D 75/5816* (2013.01); *B65D 75/5883* (2013.01); *B65D 2101/0015* (2013.01); *B65D 2575/583* (2013.01)

(58) Field of Classification Search

USPC ..... 222/92, 105, 107, 153.06, 541.6, 541.9, 222/562; 215/253, 254, 232

See application file for complete search history.

(56) References Cited

U.S. PATENT DOCUMENTS

| | | | | | |
|---|---|---|---|---|---|
| 3,235,128 | A * | 2/1966 | Milton | B65D 35/02 | 222/107 |
| 3,493,146 | A * | 2/1970 | Conners | B65D 47/283 | 222/153.06 |
| 4,478,242 | A * | 10/1984 | Bond | B65D 47/283 | 137/383 |
| 4,570,825 | A * | 2/1986 | Stull | B65D 41/3495 | 215/253 |
| 4,640,427 | A * | 2/1987 | Marino | B65D 55/06 | 156/272.8 |
| 4,669,124 | A * | 5/1987 | Kimura | B65D 41/34 | 206/807 |
| 4,702,383 | A * | 10/1987 | Wender | B65D 41/3495 | 215/230 |
| 4,739,906 | A * | 4/1988 | LoTurco | A61J 1/1443 | 222/212 |
| 5,094,357 | A * | 3/1992 | McKinney | B65D 55/06 | 215/253 |
| 6,050,451 | A * | 4/2000 | Hess, III | B65D 5/746 | 105/107 |
| 6,783,024 | B2 * | 8/2004 | Lee | B65D 75/5822 | 220/707 |
| 2007/0023452 | A1 * | 2/2007 | Tseng | B05B 11/306 | 222/153.06 |
| 2009/0050596 | A1 * | 2/2009 | Fuchs | B65D 41/3495 | 215/253 |
| 2013/0220967 | A1 * | 8/2013 | Wang | B65D 47/0838 | 215/253 |

* cited by examiner

*Primary Examiner* — Donnell Long

(74) *Attorney, Agent, or Firm* — WestRock Intellectual Property Group

(57) ABSTRACT

A tamper-evident pouch includes a pouch-like container with a dispensing fitment having a fitment body and a cap bonded to the pouch to form a closed container. At least one tamper-evident tab extends from an upper extent of the pouch and is bonded to the cap. The tab has a tear point allowing the tab to tear in this area when the cap is opened.

15 Claims, 5 Drawing Sheets

TAMPER EVIDENT POUCH AND DISPENSING FITMENT

BACKGROUND OF THE INVENTION

1. Field of the Invention

The present invention relates generally to pouch-like containers that have dispensing fitments or closures and more specifically to a pouch container or pouch-like container having a tamper-evident seal.

2. State of the Art

Dispensing containers are used in a variety of industries for dispensing of various liquid products. For example, dispensing containers may be used for shampoo, lotion, condiments, or beverages. As integrated dispensing closures become more prevalent in all industries, consumers push for their use on an ever expanding array of products and packages, and product manufacturers push for unique solutions and reduced costs to promote sales and maintain profit margins.

In some instances, containers include one or more flexible parts bonded or sealed together to form a pouch or pouch-like container. The one or more flexible parts may be made of sheets of material made of one or more layers of material. The pouch may include an opening into which a closure or dispensing fitment may be sealed. For example, pouches are used with plastic closures and dispensing fitments wherein the closure or dispensing fitment is sealed to the pouch. The closure may include a canoe portion which is positioned between two flexible sheets of material and is then welded or sealed between the two sheets. Product in the pouch may be dispensed through the closure or dispensing fitment when it is opened. The use of such pouches, closures, and dispensing fitments is known.

While closure and dispensing fitment use with pouches is known, there is a desire to visually identify when a closure or dispensing fitment of a pouch has been opened or tampered with.

BRIEF SUMMARY OF THE INVENTION

The present invention provides a tamper-evident pouch and dispensing fitment that includes a pouch-like container with an open mouth and a dispensing fitment bonded within the mouth of the container. The dispensing fitment includes a fitment body and a cap connected to the fitment body by a living hinge. At least one tamper-evident tab extends from an upper edge of the container to overlie at least a portion of the fitment body and cap. The tamper-evident tab may be bonded to the cap and in some embodiments may have a tear point adjacent the parting line of the fitment body and cap so that the tamper-evident tab is more easily torn in this area when the cap is opened.

Alternatively, in another embodiment two or more tamper-evident tabs may be bonded together above and around the top of the cap or bonded to a portion of the cap.

In another embodiment, the entire dispensing fitment may be sealed within a tear-away corner of the pouch container.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
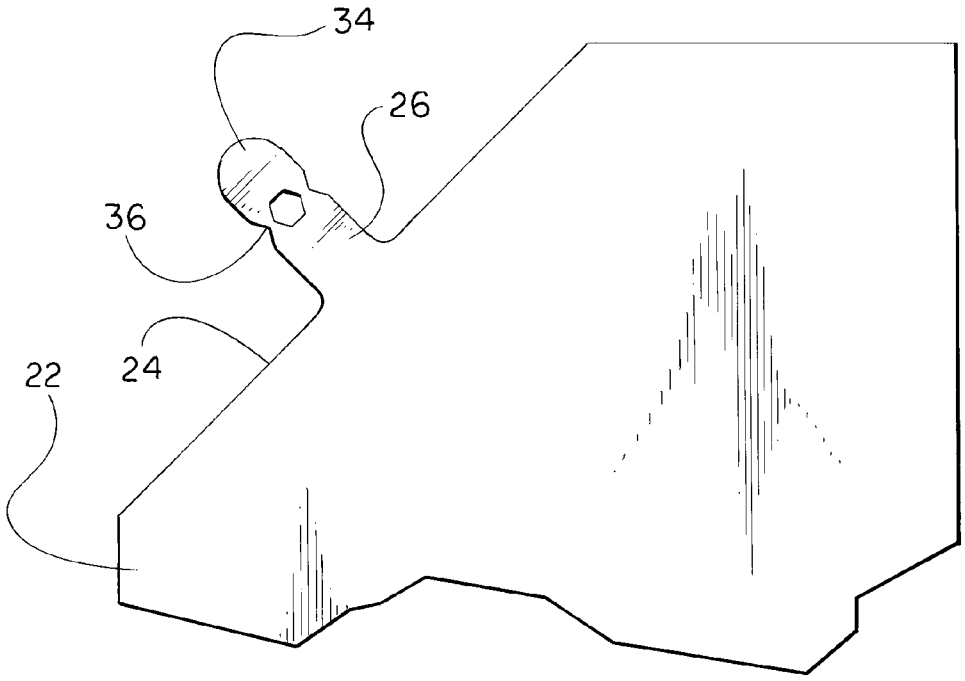
FIG. 1 shows a partial view of an end of a pouch-like container showing the tamper-evident tab prior to attachment to the dispensing fitment.
Figure 2:
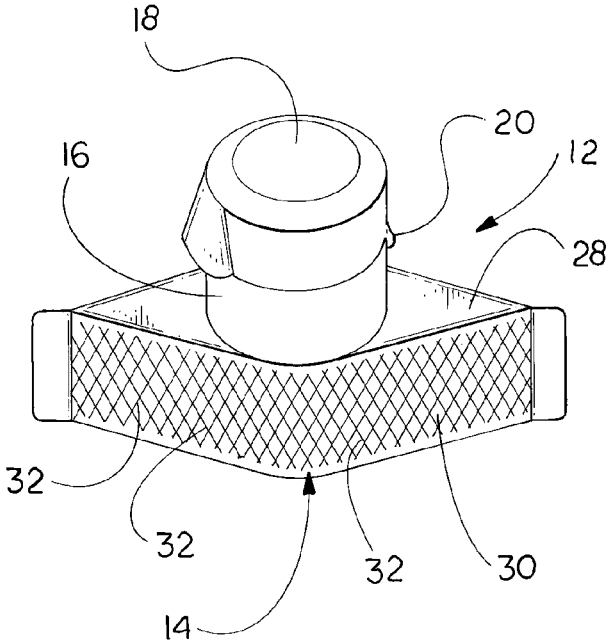
FIG. 2 shows a perspective view of an exemplary dispensing fitment.

Referring now to FIGS. 1 through 4, exemplary embodiments of the tamper-evident pouch container 10 and dispensing fitment 12 are illustrated. Referring to FIG. 2, and as may hereinafter be more fully described, the tamper-evident pouch 10 is utilized with a dispensing fitment 12 including an integrally formed fitment body 14, a dispensing neck 16, and a cap 18 connected to the fitment body 12 with a living hinge 20.

Referring to FIG. 1, the pouch-like container 10 is manufactured from a film, foil or plastic material, or other suitable materials as may be desired. The container 10 may include opposing sheets 22 (only 1 shown) which are bonded to each other along their outer peripheral edges to form a flexible container closed on three edge. Opposing upper or angled side edges 24 of the sheets form an open mouth 25 into which the dispensing fitment 12 is positioned and sealed. In accordance with some embodiments, a tamper evident tab 26 may extend outwardly from an edge 24 of at least one of the sheets 22.

According to some embodiments of the invention, a pouch-like container 10 may be constructed by sealing two opposing sheets 22 having a square or rectangular shape along three edges of the sheets 22, with one edge being left open and an open mouth 25 or hole left in one of the sealed edges. A dispensing fitment 12 may be positioned in the open mouth 25 and sealed therein or bonded to the sheets 22 such that three sides of the pouch-like container 10 are sealed. At the same time, a portion of a tamper evident tab 26 may be bonded to the dispensing fitment 12. The opening in the unsealed edge may be used to fill the pouch-like container 10 with a product and then sealed to contain the product in the pouch-like container 10.

In still other embodiments of the invention, the sheets 22 may be any size or shape desired. The edges of two sheets 22 may be sealed such that an opening for a dispensing fitment 12 remains and an opening for filling remains. A dispensing fitment 12 may then be sealed in the dispensing fitment opening and a portion of the tamper evident tab 26 bonded to or sealed against a portion of the dispensing fitment 12 according to various embodiments of the invention.

Figure 3:
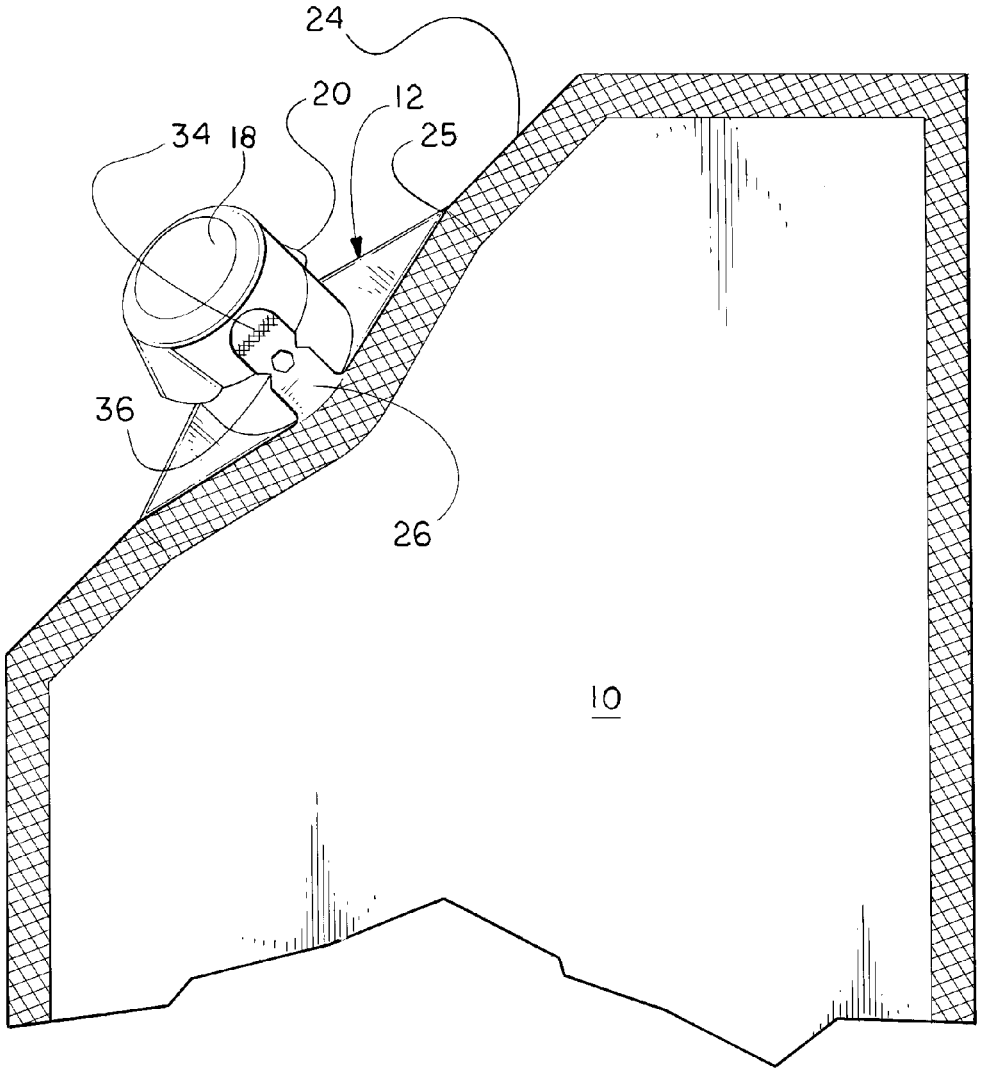
FIG. 3 shows a partial view of a pouch-like container bonded to a dispensing fitment with the tamper-evident tab extending upwardly and bonded to a cap of the dispensing fitment.

The dispensing fitment 12 is manufactured separately from a pouch-like container 10 and then mounted within the open mouth 25 of the pouch 10. More specifically, the fitment body 14 includes a closure deck 28 and a "canoe"-shaped skirt portion 30 extending downwardly from the closure deck 28. The skirt portion 30 is receivable within the open mouth 25 of the pouch-like container 10 as shown in FIG. 3. Heat sealing formations 32—as illustrated in FIG. 2—provided on an outer surface of the skirt portion 30 may be configured and arranged to facilitate heat sealing the skirt portion 30 to an inner surface of the sheets 22 of the pouch container 10. Thus, once the dispensing fitment 12 is placed within the open mouth 25 of the pouch 10 and an outer surface of the skirt portion 30 is in facing engagement with an inner surface of the sheets 22, the heat sealing formations are heated, forming a seal between the container 10 and the fitment 12. This seal between the skirt portion 30 and the sheets 22 is sufficiently strong that the seal does not deteriorate during shipment and normal use of the product. While a particular pattern for the heat sealing formation 32 is illustrated in FIG. 2, it is understood that other patterns or heat sealing formations 32 could also be employed.

At the time the dispensing fitment 12 is bonded to the container 10, an upper portion 34 of the tamper-evident tab 26 may be bonded to the side wall of the cap 18. In other embodiments, the upper portion 34 of the tab 26 may be bonded to other areas of the cap 18. In order to facilitate tearing of the tab 26, the tab 26 may include a tear line 36, which is formed by narrowed, weakened or scored areas in the central portion of the tab 26. In particular, this tear line 36 may be formed at the parting line between the fitment body 14 and the cap 18.

While a particular tear line 36 design is illustrated in FIGS. 1 through 4, it is understood that other designs or configurations may also be used with various embodiments of the invention.

Figure 4:
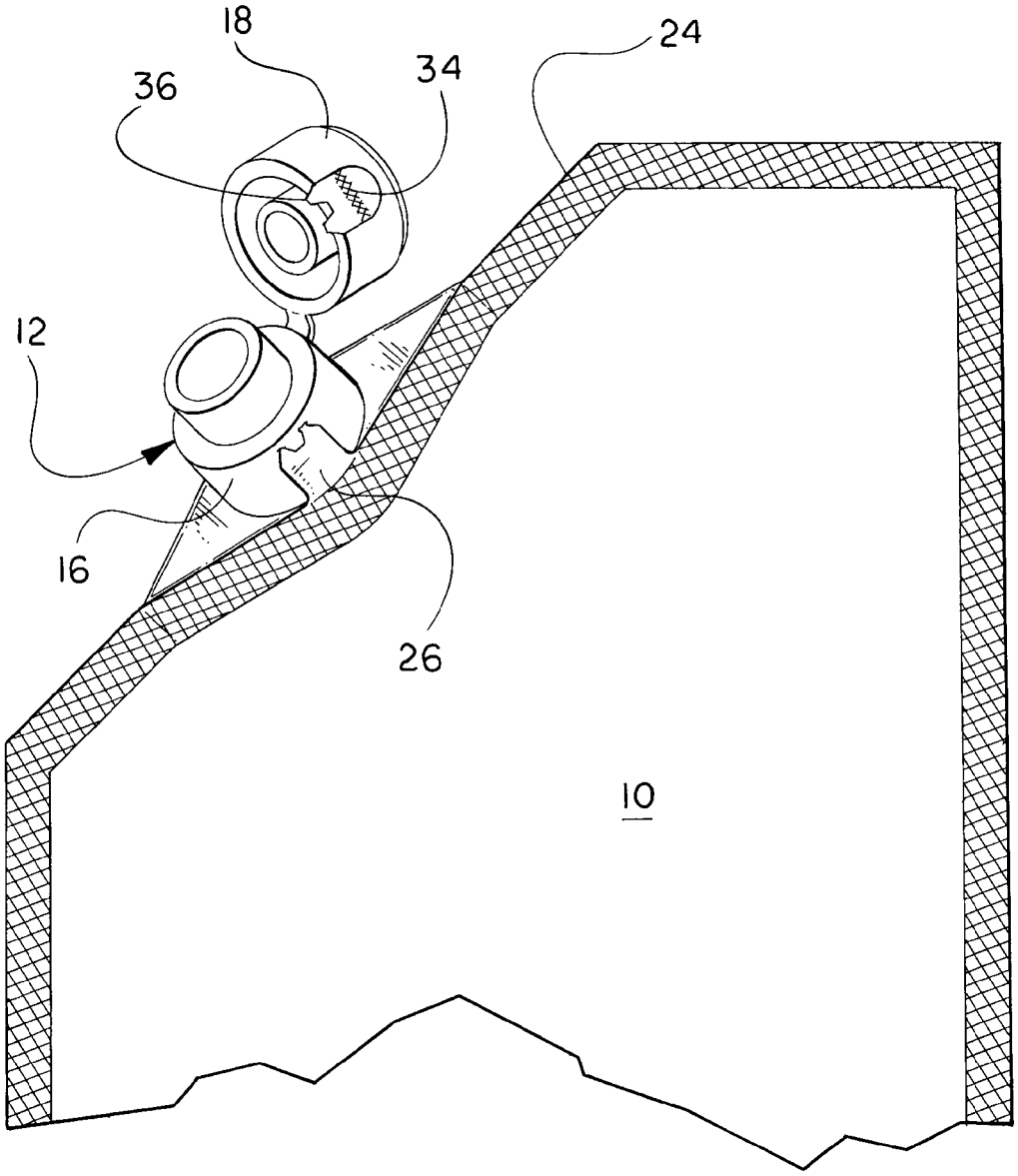
FIG. 4 shows a partial view of a pouch-like container with the cap on the dispensing fitment opened and the tamper-evident tab is broken along the tear line.

Referring to FIG. 4, opening of the hinged cap 18 breaks the tab 26 at the tear line 36, thereby evidencing that the fitment cap 18 has been previously opened. Although a hinged cap 18 is shown, the cap 18 may be threaded, twist open, push-pull, snap on or other style as, is known in the art that requires the cap 18 be moved from a closed position to an open position. Further, while a unitary dispensing fitment 12 is illustrated, it is understood that multi-part dispensing fitments 12 may also be used with various embodiments of the invention. For example, a two-piece dispensing fitment 12 having a screw cap that is separable from the fitment body 14 may be used and an upper portion 34 of the tamper-evident tab 26 may be sealed, bonded to, or otherwise connected to the removable cap.

Figure 5:
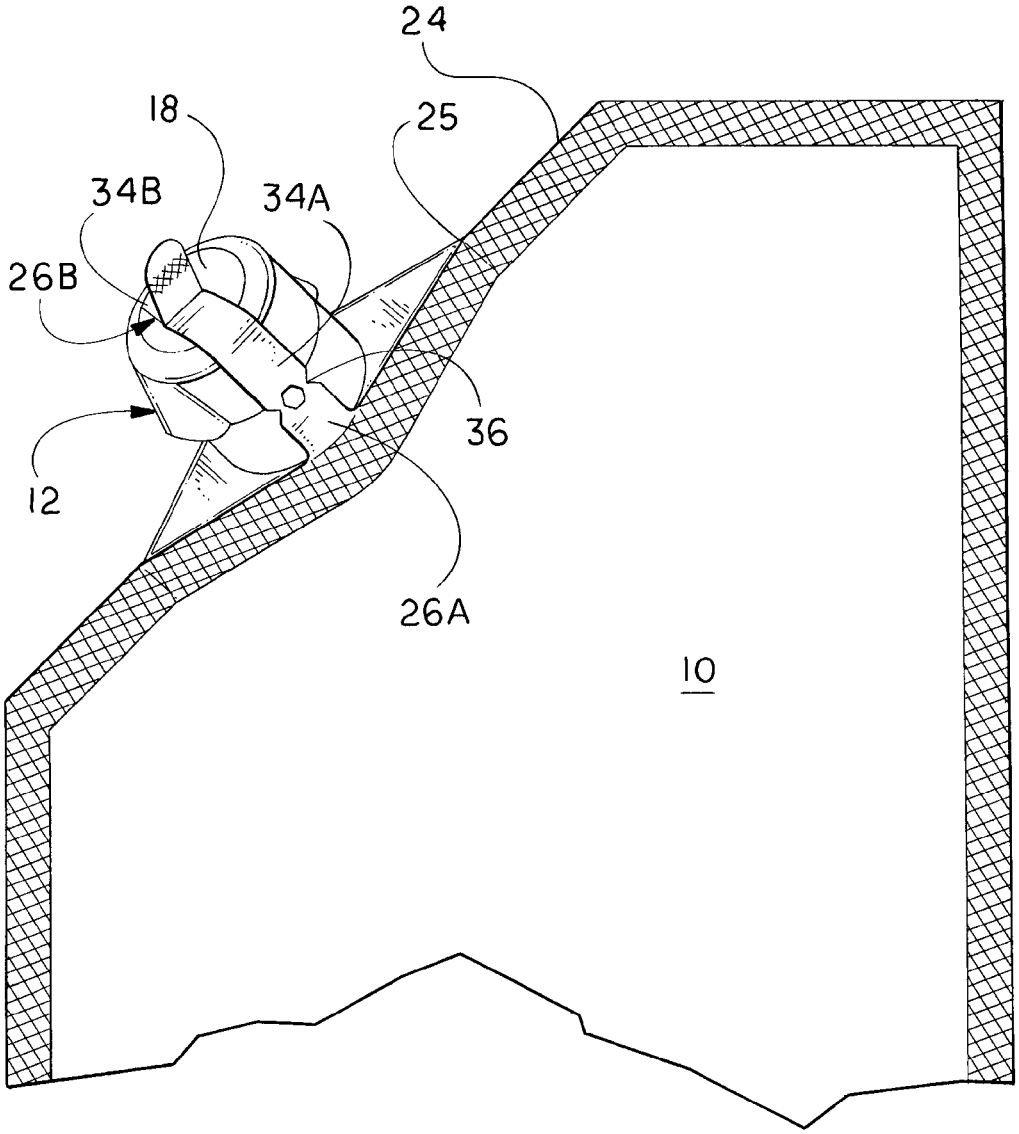
FIG. 5 shows a partial view of another exemplary embodiment of a tamper-evident pouch where two tamper-evident tabs are bonded together above and around the top of the cap.

Referring to FIG. 5, an alternative embodiment of the tamper-evident pouch and fitment is shown. This exemplary embodiment may include two tamper-evident tabs 26A and 26*b* which extend upwardly and are bonded to each other above and around the top of the cap 18. The tabs 26A, 26B may also be bonded directly to the cap 18. To open the cap 18, the tabs 26A, 26B may be broken first by pulling on them or by opening the cap 18, forcing the tear lines 36 to fail.

Figure 6:
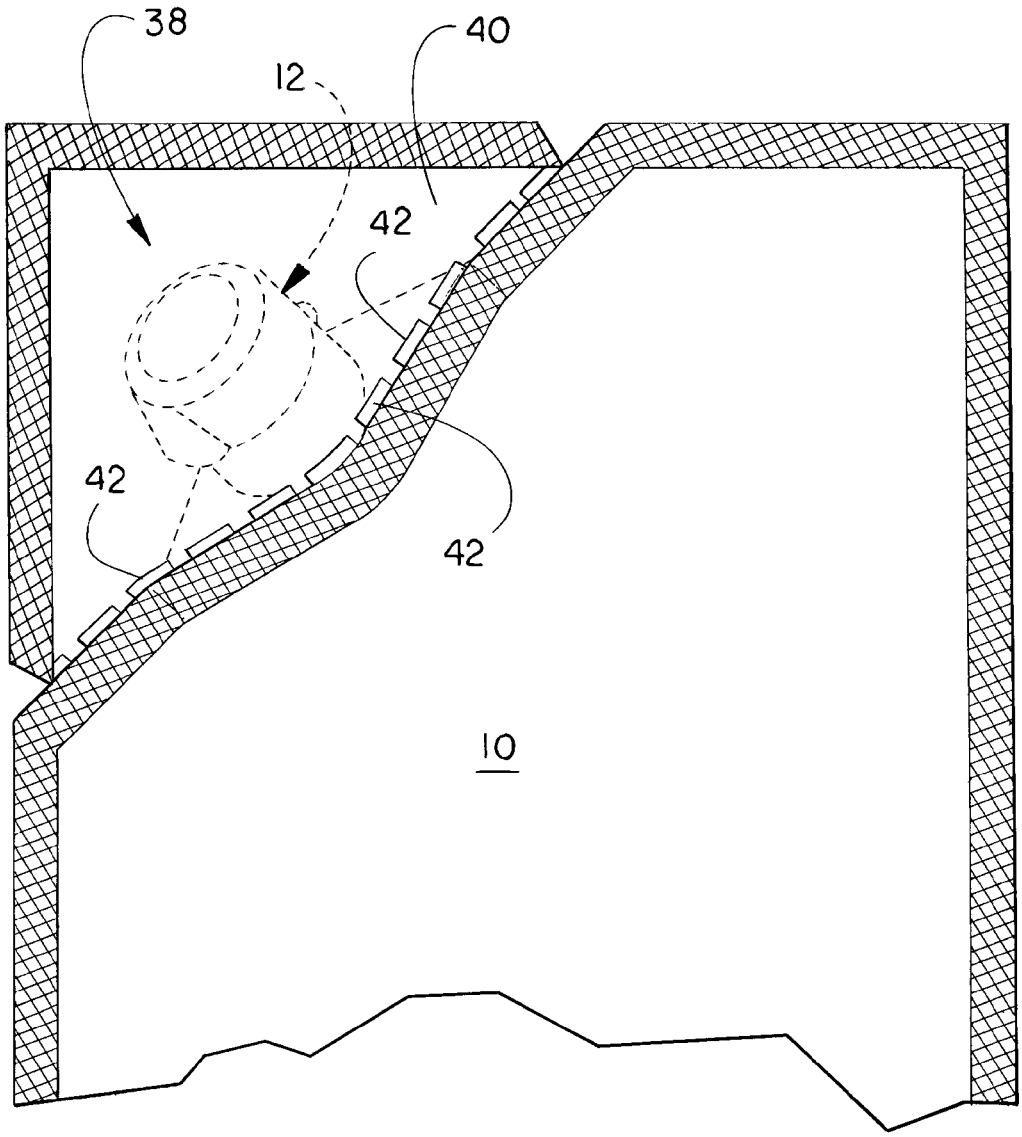
FIG. 6 shows a partial view of a second alternative embodiment of a tamper-evident pouch where the entire dispensing fitment is sealed within a tear-away corner of the pouch.

Referring to FIG. 6, another exemplary embodiment of a tamper-evident pouch and fitment is illustrated where the entire dispensing fitment 12 is sealed within a tear-away corner 38 of the pouch 10. The tear-away corner 38 is formed by bonding two opposing corner flaps 40 together during installation of the dispensing fitment 12 in the open mouth 25 of the container 10. In this regard, the sheets 22 include extended perforations or weakened areas 42 along a line at a point above the open mouth 25 to facilitate the enter corner 38 being torn away from the remainder of the pouch to expose the dispensing fitment 12 for use.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular exemplary forms herein shown and described except insofar as limited by the scope of the appended claims.

What is claimed is:

1. A tamper-evident pouch, comprising:

a pouch having an open mouth and a tamper-evident tab extending therefrom, the tamper-evident tab having a tear point with an upper portion; and a dispensing fitment having a body and a cap, the dispensing fitment bonded to the open mouth of the pouch, the upper portion of the tab bonded to the cap.

2. The tamper-evident pouch of claim 1, wherein the cap is connected to the body by a living hinge.

3. The tamper-evident pouch of claim 1, wherein the pouch comprises two sealed sheets.

4. The tamper-evident pouch of claim 3, wherein the sheets comprise a material selected from the group consisting of film, foil, and plastic material.

5. The tamper-evident pouch of claim 1, further comprising a second tamper evident tab bonded to the cap.

6. A tamper-evident pouch, comprising:

a first sheet of pouch material;

a second sheet of pouch material at least partially sealed to the first sheet of pouch material;

a first tamper-evident tab extending from the first sheet of pouch material;

a dispensing fitment sealed between the first sheet of pouch material and the second sheet of pouch material adjacent the first tamper-evident tab; and wherein the first tamper-evident tab is partially bonded to the dispensing fitment.

7. The tamper-evident pouch of claim 6, wherein the first tamper-evident tab further comprises a tear line and an upper portion above the tear line.

8. The tamper-evident pouch of claim 7, wherein the portion of the first tamper-evident tab partially bonded to the dispensing fitment is the upper portion.

9. The tamper-evident pouch of claim 6, wherein the first sheet of pouch material comprises a material selected from the group consisting of a film, foil, and plastic material.

10. The tamper-evident pouch of claim 6, wherein the second sheet of pouch material comprises a material selected from the group consisting of a film, foil, and plastic material.

11. The tamper-evident pouch of claim 6, further comprising a fill opening between the first sheet and the second sheet.

12. The tamper-evident pouch of claim 6, further comprising a product between the first sheet and the second sheet and wherein the edges of the first sheet are completely sealed against the edges of the second sheet except where the first sheet and second sheet are sealed to the dispensing fitment.

13. The tamper-evident pouch of claim 6, further comprising a second tamper-evident tab extending from the second sheet of pouch material.

14. The tamper-evident pouch of claim 13, wherein the second tamper-evident tab is at least partially bonded to the dispensing fitment.

15. The tamper-evident pouch of claim 13, wherein the second tamper-evident tab is at least partially bonded to the first tamper-evident tab.

* * * * *